US011559172B2

(12) United States Patent
Lee

(10) Patent No.: US 11,559,172 B2
(45) Date of Patent: Jan. 24, 2023

(54) FOOT CLEANING DEVICE

(71) Applicant: Kyu Song Lee, Amherst, NY (US)

(72) Inventor: Kyu Song Lee, Amherst, NY (US)

( * ) Notice: Subject to any disclaimer, the term of this patent is extended or adjusted under 35 U.S.C. 154(b) by 203 days.

(21) Appl. No.: 17/096,392

(22) Filed: Nov. 12, 2020

(65) Prior Publication Data

US 2022/0142416 A1 May 12, 2022

(51) Int. Cl.
*A47K 7/02* (2006.01)
*A47K 7/04* (2006.01)
*A46B 13/00* (2006.01)

(52) U.S. Cl.
CPC ..... *A47K 7/026* (2013.01); *A46B 13/001* (2013.01); *A47K 7/04* (2013.01); *A46B 2200/1006* (2013.01)

(58) Field of Classification Search
CPC ..... A47K 7/02; A47K 7/026; A47L 23/02
See application file for complete search history.

(56) References Cited

U.S. PATENT DOCUMENTS 1,019,672 A * 3/1912 Lineback ..... A47L 23/02 15/34
1,648,578 A * 11/1927 Croy ..... A47L 23/02 15/30
2,448,797 A 9/1948 Gustlin
2,963,723 A * 12/1960 Nappi ..... A47L 23/02 15/311
3,022,528 A * 2/1962 Pagano ..... A43D 95/16 15/31
3,172,137 A * 3/1965 Albert ..... A47L 23/02 15/36
3,393,414 A * 7/1968 Pastorini ..... A47L 23/02 15/31
3,729,761 A * 5/1973 Lashley ..... A47L 23/02 15/31
3,837,334 A 9/1974 Johnson
4,192,296 A 3/1980 St. Mary
6,210,349 B1 4/2001 Naruse et al.
6,419,650 B1 7/2002 Ryan et al.
6,602,212 B1 8/2003 Ahn
6,662,398 B1 12/2003 Thomson
D693,934 S 11/2013 Lin
D711,547 S 8/2014 Hardy et al.
9,609,984 B1 * 4/2017 Kelly ..... A47K 7/04
2012/0066847 A1 * 3/2012 Bai ..... A47L 23/02 15/4

(Continued)

OTHER PUBLICATIONS

Existing Product, http://blog.daum.net/_blog/BlogTypeView.do?blogid=05uEz&articleno=14111297&categoryId=691567&regdt=20080219101804 [date accessed: Aug. 26, 2020].

*Primary Examiner* — Michael D Jennings
(74) *Attorney, Agent, or Firm* — Michael J. Feigin, Esq.; Feigin and Fridman

(57) ABSTRACT

A cleaning device includes at least one T-shaped frame and a first sheet roll surrounding an internal space. The T-shaped frame abuts the internal space. First and second rollers are spaced apart from each other within the internal space and are disposed at opposite first and second ends of the at least one T-shaped frame, such that the first sheet roll abuts each of the first and second rollers. A third roller, exterior to, and spaced apart from, the first sheet roll, rotatably attached to the at least one T-shaped frame at a third end thereof.

14 Claims, 11 Drawing Sheets

(56) References Cited

U.S. PATENT DOCUMENTS

| | | | | |
|---|---|---|---|---|
| 2015/0283023 | A1 | 10/2015 | Phillips | |
| 2019/0262220 | A1 | 8/2019 | Smith | |
| 2020/0138666 | A1* | 5/2020 | Piucci, Jr. ..... | A61H 15/0092 |

* cited by examiner

FOOT CLEANING DEVICE

FIELD OF THE DISCLOSED TECHNOLOGY

The disclosed technology relates generally to body cleaning devices and, more specifically, to a foot cleaning device.

BACKGROUND OF THE DISCLOSED TECHNOLOGY

Cleaning techniques can be applied to many body parts, including back, arms, legs and feet.

Various devices for massaging or cleaning feet are known in the art.

U.S. Pat. No. 6,033,372 to Tarbet et al. shows a device for massaging hands, arms, legs, and feet. The device has two rigid rollers covered in protrusions, each placed upon an axle which extends into a pair of shafts on either end. The rollers are held together with elastic cord such that the pair of rollers may be pushed apart to admit a body part while remaining tightly pressed to that body part.

U.S. Pat. No. 6,602,212 to Ahn shows a foot clean device having a set of water jets and an acupuncture roller. The roller is installed below a center portion of a footstool.

U.S. Pat. No. 9,609,984 to Kelly shows a foot scrubbing device with three free-rolling roller brushes arranged in a frame. Thus, Kelly appears to show at least two spaced-apart rollers, and a method of use which includes placing a foot on the at least two spaced-apart rollers and moving the foot toward and/or away from one of the at least two spaced-apart rollers.

However, there remains a need in the art for a foot cleaning device for cleaning the bottom of the foot or heel simultaneously with cleaning another portion of the foot or leg.

SUMMARY OF THE DISCLOSED TECHNOLOGY

The disclosed technology relates generally to body cleaning devices, and, more specifically, to foot cleaning devices.

In accordance with an embodiment of the disclosed technology, there is provided a cleaning device including at least one T-shaped frame and a first sheet roll surrounding an internal space, the at least one T-shaped frame abutting the internal space. First and second rollers, are spaced apart from each other within the internal space and are disposed at opposite first and second ends of the at least one T-shaped frame, the first sheet roll abutting each of the first and second rollers. A third roller, exterior to, and spaced apart from, the first sheet roll, rotatably attached to the at least one T-shaped frame at a third end thereof.

In some embodiments, the first and second rollers form part of a plurality of interconnected rollers disposed within the internal space, wherein the first sheet roll abutting each of the plurality of interconnected rollers. The plurality of interconnected rollers may be interconnected by a first linking band, such that when any one of the plurality of interconnected rollers is rotated, the other rollers rotate therewith.

In some embodiments, the plurality of interconnected rollers are held inline with, and parallel to each other.

In some embodiments, the at least one T-shaped frame includes two parallel T-shaped frames abutting opposing sides of the internal space defined by the first sheet roll, each of the two parallel T-shaped frames including a metal lip surrounding the plurality of interconnected rollers. In some such embodiments, the third roller is held apart from the plurality of interconnected rollers by the metal lips of the two parallel T-shaped frames.

In some embodiments, the third roller is connected to the plurality of interconnected rollers by a second linking band, such that a line from a center of the third roller to a center of a closest roller of the plurality of interconnected rollers is substantially perpendicular to a line running through a center of each roller of the plurality of interconnected rollers. In some such embodiments, rotation of the third roller causes rotation of the plurality of interconnected rollers.

In some embodiments, each of the first, second, and third rollers includes two end portion having a first diameter, and a central portion, disposed between the end portions, having a second diameter, the second diameter being smaller than the first diameter.

In some embodiments, the third roller is enclosed in a second sheet roll. In some embodiments, at least one of the first sheet roll and the second sheet roll has a textured exterior surface.

In accordance with another embodiment, there is provided a method of using the cleaning device according to the disclosed technology as described hereinabove, the method including placing a foot between the first sheet roll and the third roller, and moving the foot toward and/or away from a roller of the first and second rollers.

In accordance with yet another embodiment, there is provided a method of using the cleaning device according to the disclosed technology as described hereinabove, the method including placing a sole of a foot on the third roller, and placing a heel of the foot on the first sheet roll, and moving the foot toward and/or away from a roller of the first and second rollers.

In accordance with a further embodiment, there is provided a method of using the cleaning device according to the disclosed technology as described hereinabove, the method including placing a sole of a foot on the first sheet roll, and placing an ankle supporting the foot on the third roller, and moving the foot toward and/or away from a roller of the first and second rollers.

DETAILED DESCRIPTION OF EMBODIMENTS OF THE DISCLOSED TECHNOLOGY

In an embodiment of the disclosed technology, a foot cleaning device includes at least one T-shaped frame and a first sheet roll surrounding an internal space. The T-shaped frame abuts the internal space. First and second rollers are spaced apart from each other within the internal space and are disposed at opposite first and second ends of the at least one T-shaped frame, such that the first sheet roll abuts each of the first and second rollers. A third roller, exterior to, and spaced apart from, the first sheet roll, rotatably attached to the at least one T-shaped frame at a third end thereof.

Embodiments of the disclosed technology will become clearer in view of the following description of the drawings.

Figure 1A:
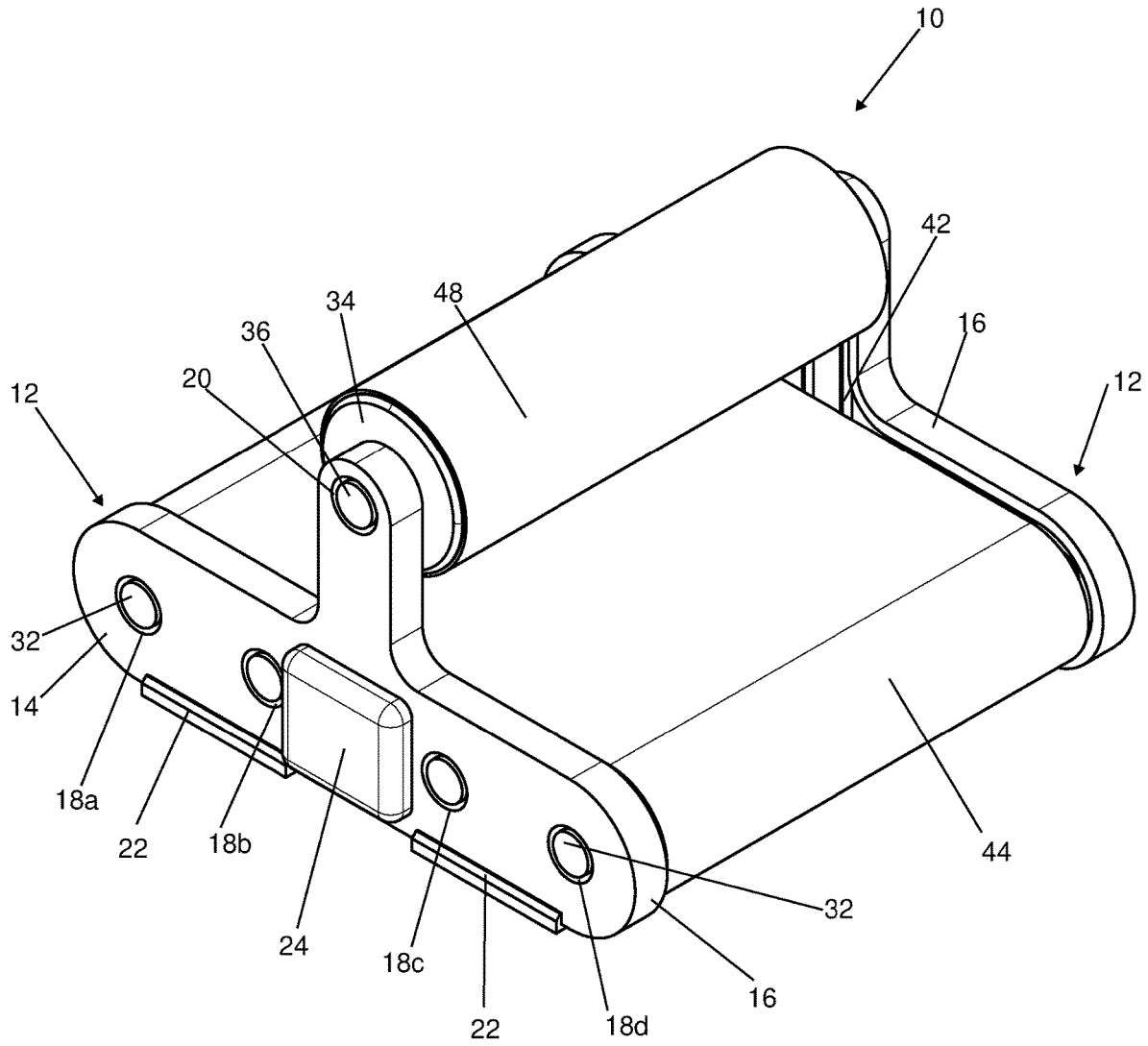
FIGS. 1A and 1B show perspective view illustrations of a foot cleaning device, according to embodiments of the disclosed technology.
Figure 1B:
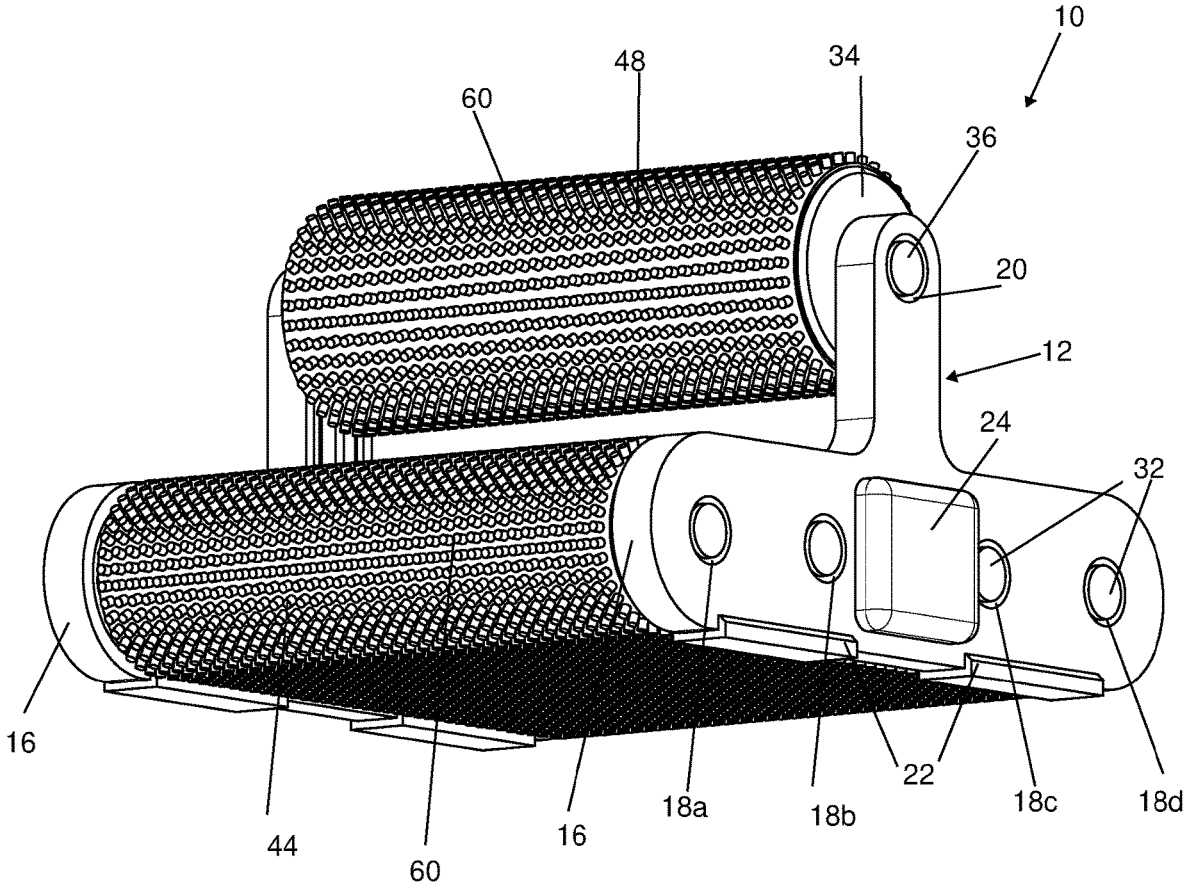
Figure 2:
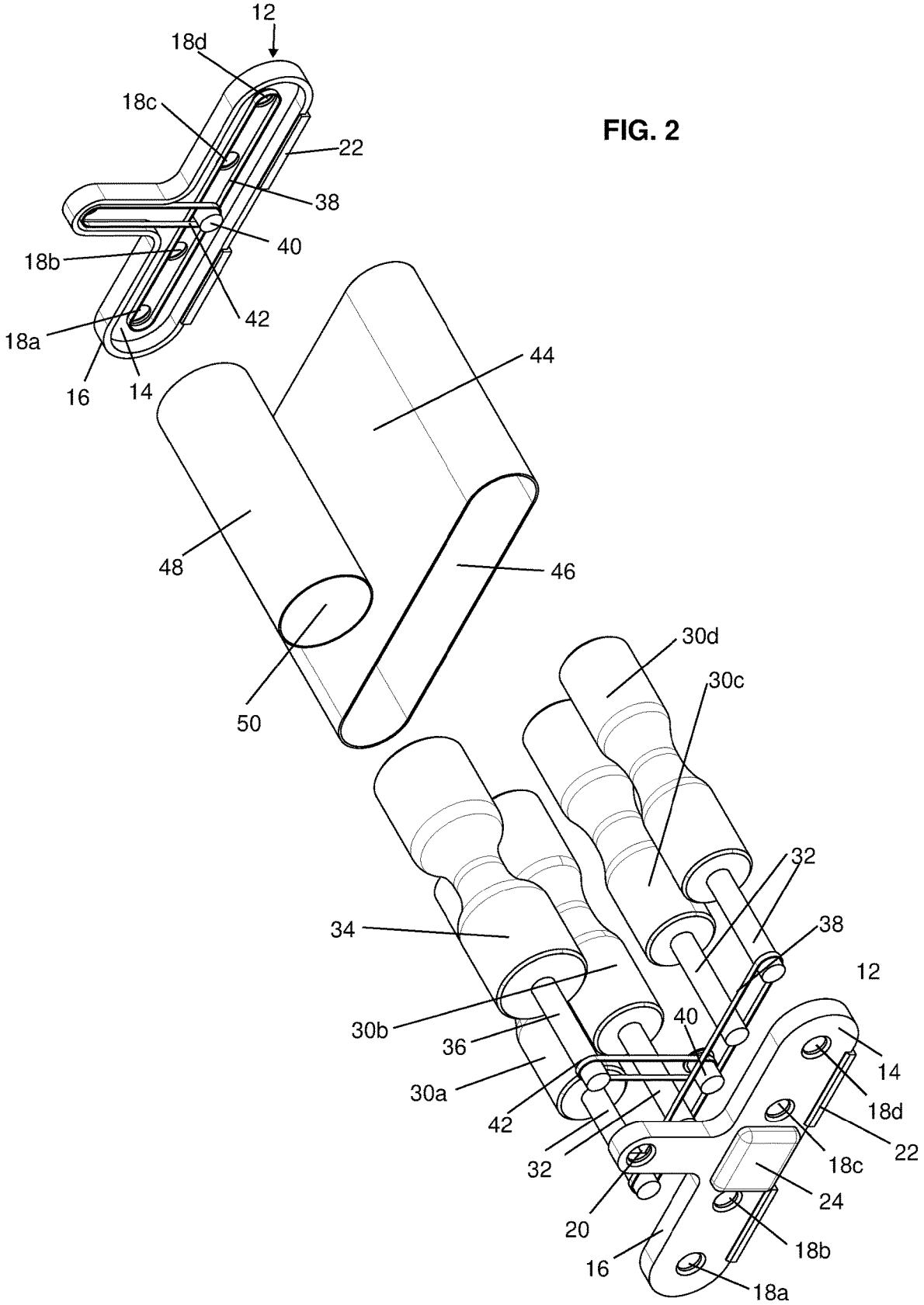
FIG. 2 is an exploded perspective view illustration of the foot cleaning device of FIGS. 1A and 1B.

Reference is now made to FIGS. 1A and 1B, and 1B show perspective view illustrations of a foot cleaning device 10, according to embodiments of the disclosed technology, and to FIG. 2, which is an exploded perspective view illustration of the foot cleaning device 10.

As seen, device 10 includes a pair of T-shaped frame portions 12, each including a frame base region and a frame protrusion portion. Each T-shaped frame portion includes a planar surface 14 surrounded by an enclosing lip 16. Four axis receiving sockets 18*a*, 18*b*, 18*c*, and 18*d* are formed in the base region of planar surface 14, and are arranged in a straight line. An upper axis receiving socket 20 is formed in the protrusion region of planar surface 14, vertically above the straight line formed by the four sockets 18. A pair of locking supports 22 is disposed at the bottom of each T-shaped frame, and extends inwardly from lip 16, away from planar surface 14. A substantially square protrusion 24 extends outwardly from the base region of planar surface 14.

As seen clearly in FIG. 2, four rollers 30*a*, 30*b*, 30*c*, and 30*d* and, each mounted on an axis 32, extend between axis receiving sockets 18*a*, 18*b*, 18*c*, and 18*d*, respectively. Similarly, an upper roller 34 mounted on an axis 36 extends between upper axis receiving sockets 20. Each of rollers 30*a*, 30*b*, 30*c*, 30*d*, and 34 includes end portions having a first diameter, and a central portion which is indented, or sloped, relative to the end portions and has a second diameter, the second diameter being smaller than the first diameter. In some embodiments, all rollers 30*a*, 30*b*, 30*c*, and 30*d* have the same first and second diameters. In some embodiments, at least one of the first and second diameters of upper roller 34 is different from a corresponding one of the first and second diameters of the rollers 30*a*, 30*b*, 30*c*, and 30*d*.

First linking bands 38, which may be chains, elastic bands, or any other suitable bands, are held taut around axes 32 at each thereof, the first linking bands being disposed within lips 16 of T-shaped frame portions 12. A peg 40 is disposed substantially at the center of each of first linking bands 38 and in engagement therewith, and is adapted to be seated within protrusion 24 of T-shaped frame portion 12. Second linking bands 42, which may be chains, elastic bands, or any other suitable bands, are held taut around axis 34 and peg 40, the second linking bands being disposed within lips 16 of T-shaped frame portions 12. Linking bands 38 and 42 link the rollers 30*a*, 30*b*, 30*c*, 30*d*, and 34 to one another, such that all the rollers rotate together.

A sheet roll 44 forms an internal space 46, which internal space accommodates rollers 30*a*, 30*b*, 30*c*, and 30*d*, such that sheet roll 44 abuts surfaces of the rollers and engages all the rollers. A second sheet roll 48 forms an internal space 50, which receives the upper roller 34. In some embodiments, edges of sheet roll 44 are enclosed within lip 16 of T-shaped frame portions 12, whereas edges of sheet roll 48 abut an edge of lip 16. In some embodiments, this arrangement is achieved by roller 34 being slightly shorter than rollers 30*a*, 30*b*, 30*c*, and 30*d*. In other embodiments, both sheet rolls 44 and 48 abut edges of lip 16. Locking supports 22 ensure that sheet roll 44 remains in engagement with rollers 30*a*, 30*b*, 30*c*, and 30*d* at a bottom surface thereof.

In the embodiment illustrated in FIGS. 1A and 1*n* FIG. 2, the external surfaces of sheet rolls 44 and 48 are smooth surfaces. In the embodiment illustrated in FIG. 1B, the external surfaces of sheet rolls 44 and 48 are textured surfaces. Specifically, in the embodiment of FIG. 1B, the external surfaces of sheet rolls 44 and 48 include a plurality of outwardly extending, flexible and resilient protrusions 60. However, other textured surfaces are considered within the scope of the disclosed technology.

Rollers 44 and 48, in embodiments of the disclosed technology, are made of or coated with silicone, a polymer made up of siloxane. This is due to the low toxicity, inability to support growth of microbes, and ability to form a water-tight surface.

FIGS. 3A, 3B, 3C, and 3D are, respectively, front view, top view, and two side view planar illustrations of foot cleaning device 10.

Figure 3A:
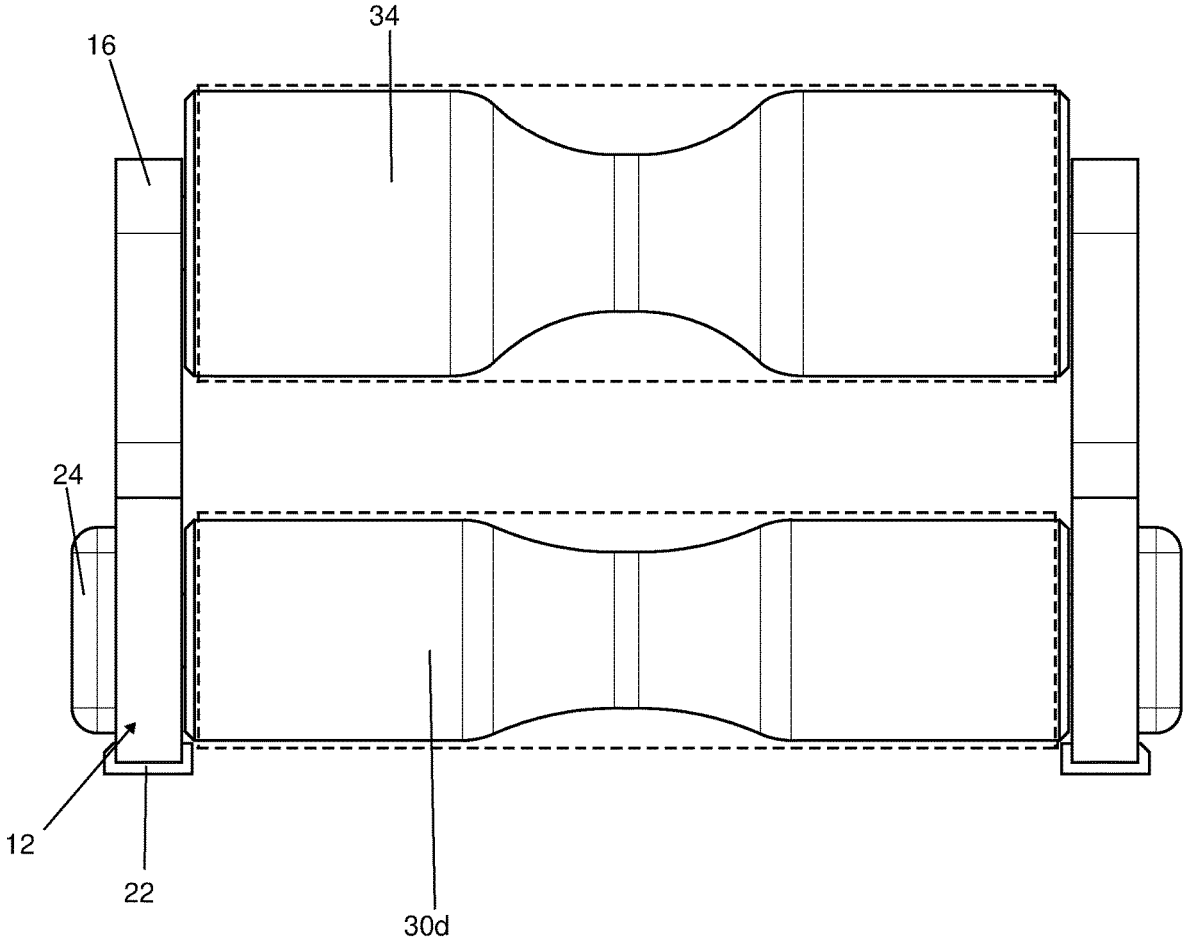
FIGS. 3A, 3B, 3C, and 3D are, respectively, front view, top view, and two side view planar illustrations of the foot cleaning device of FIGS. 1A and 1B, each having components removed therefrom.
Figure 3B:
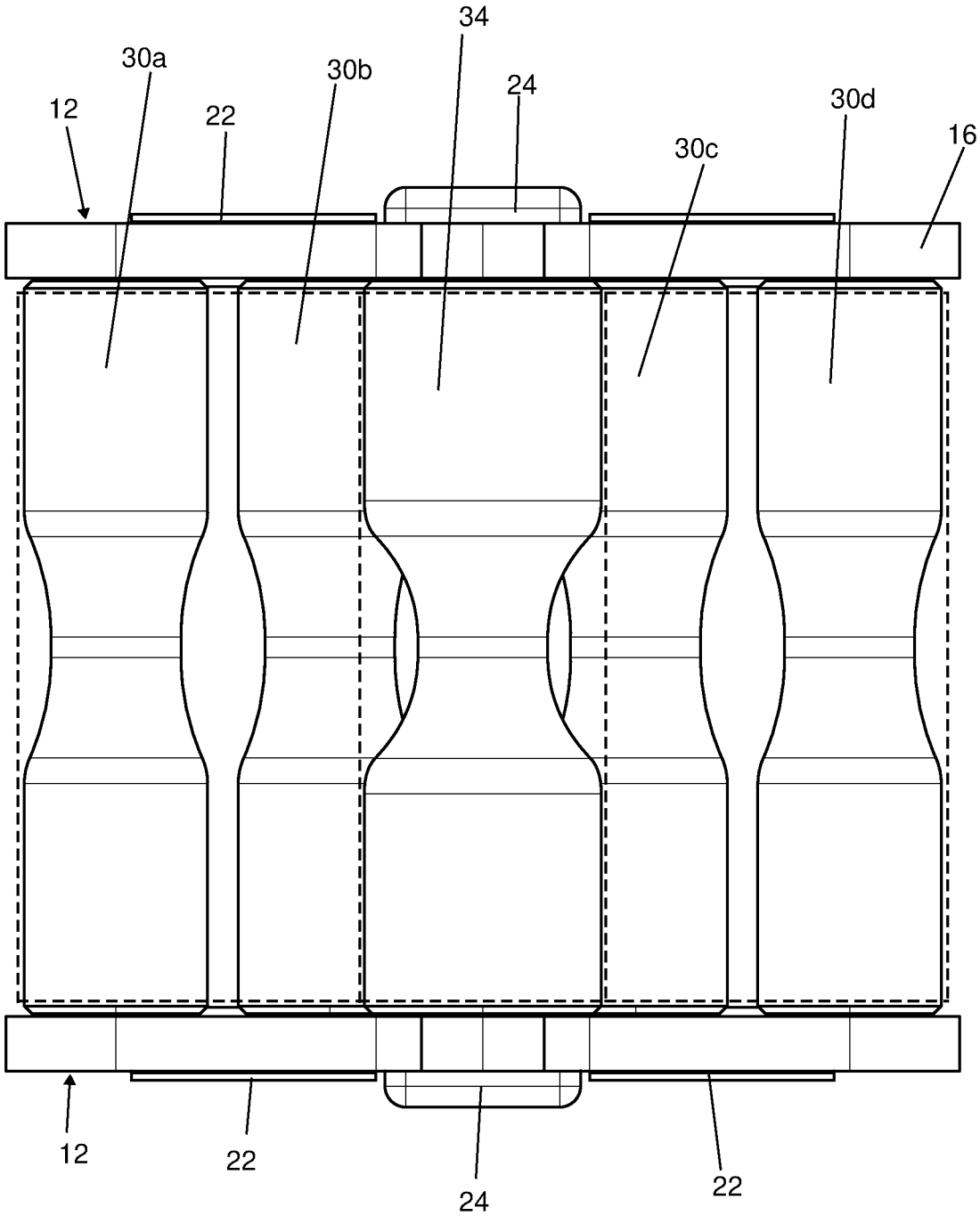

In FIGS. 3A and 3B, the sheet rolls 44 and 48 have been removed, thereby exposing the arrangement of rollers 30*a*-30*d* and 34. As seen, the rollers need not engage one another. Rather, the connection of the rollers by linking bands 38 and 42 is the reason that the rollers rotate together with one another.

Figure 3C:
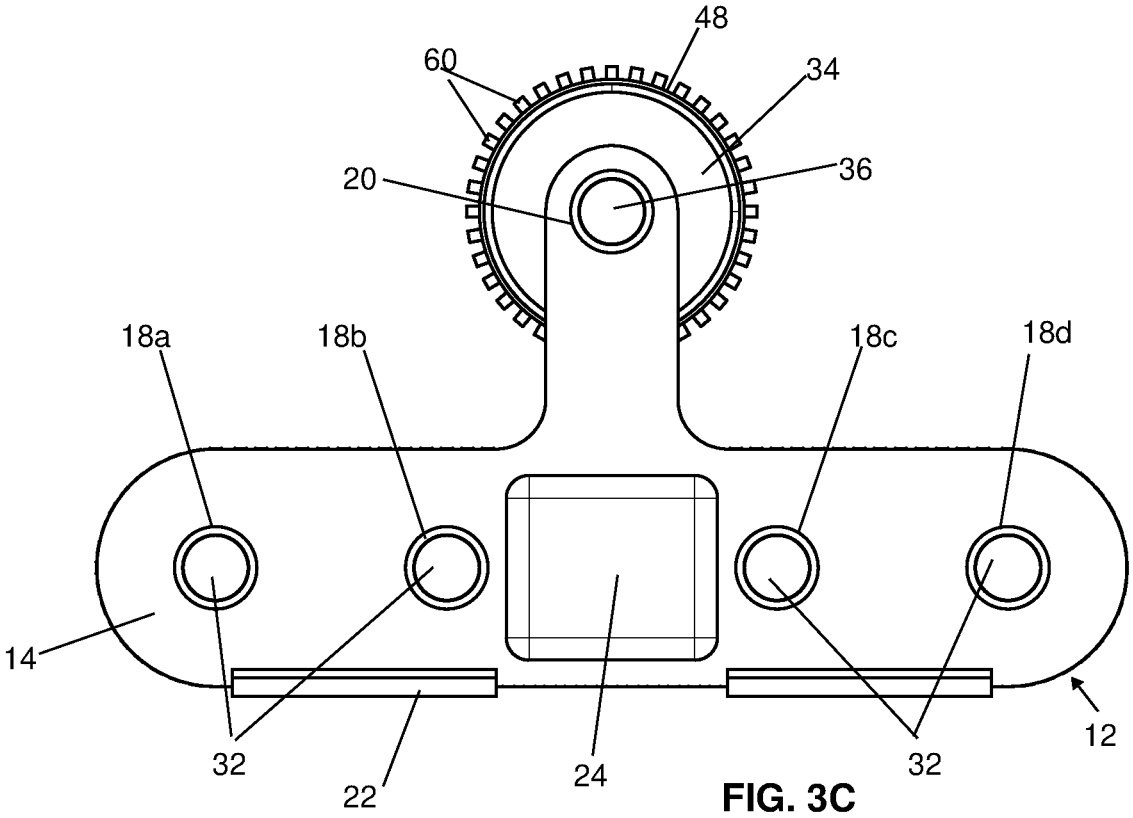

FIG. 3C is a side view illustration of the foot cleaning device 10 of FIG. 1B, having sheet roll 44 removed therefrom, or replaced with a sheet roll having a smooth external surface.

Figure 3D:
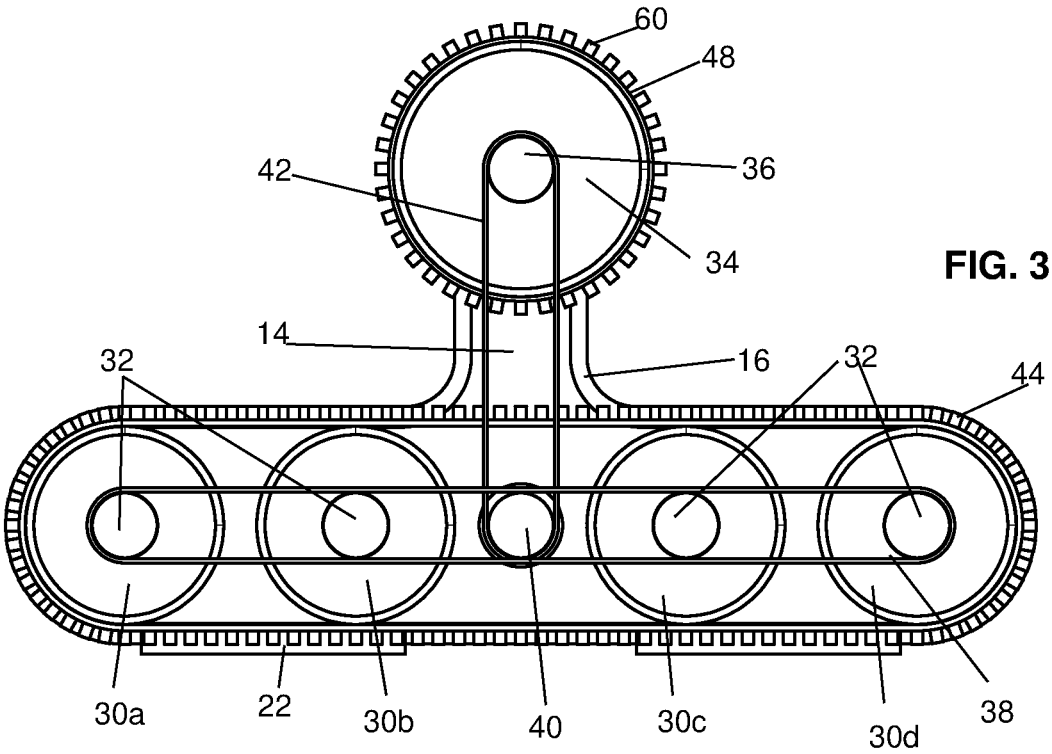

FIG. 3D is a side view illustration of the foot cleaning device 10 of FIG. 1B, having one of T-shaped frame portions 12 removed therefrom, thereby exposing the linking bands 38 and 42, as well as peg 40.

Figure 4A:
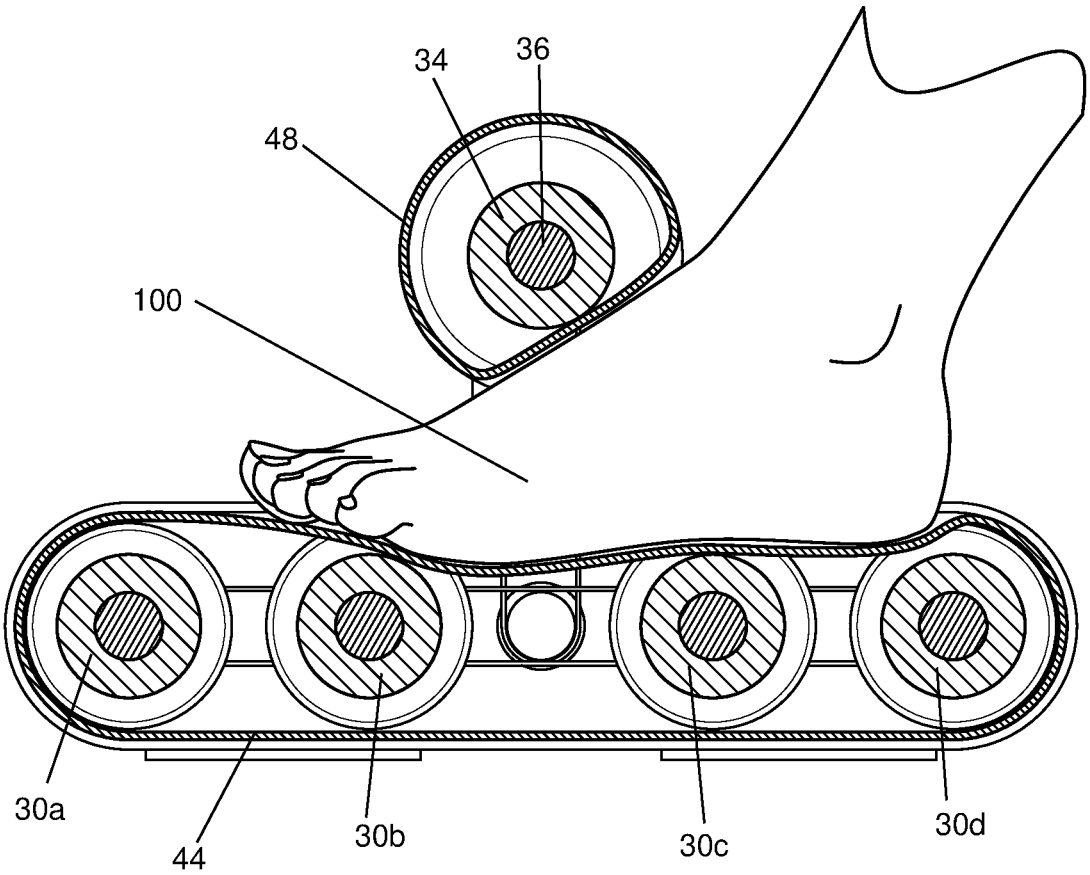
FIGS. 4A, 4B, and 4C are sectional illustrations of the device of FIG. 1A, during use thereof, according to embodiments of the disclosed technology.
Figure 4B:
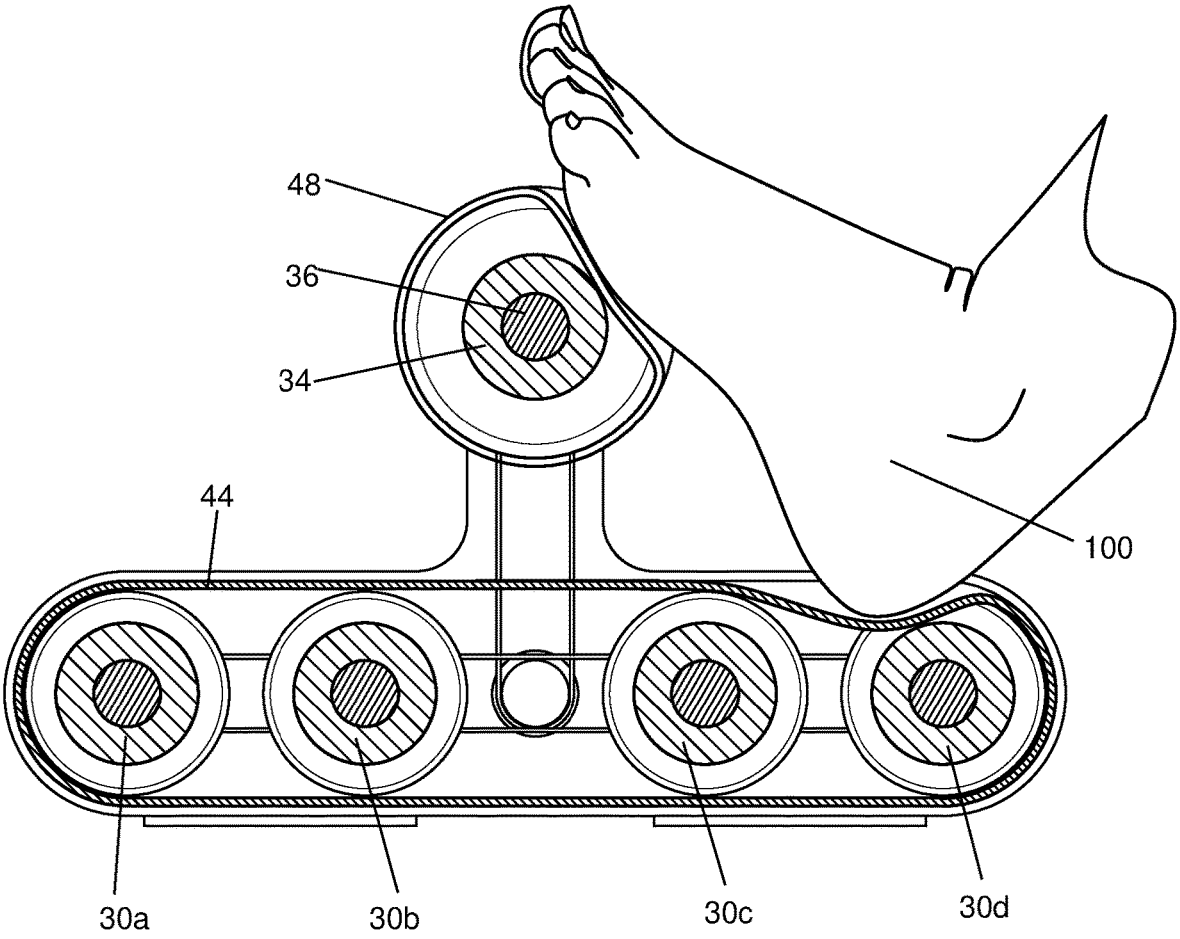
Figure 4C:
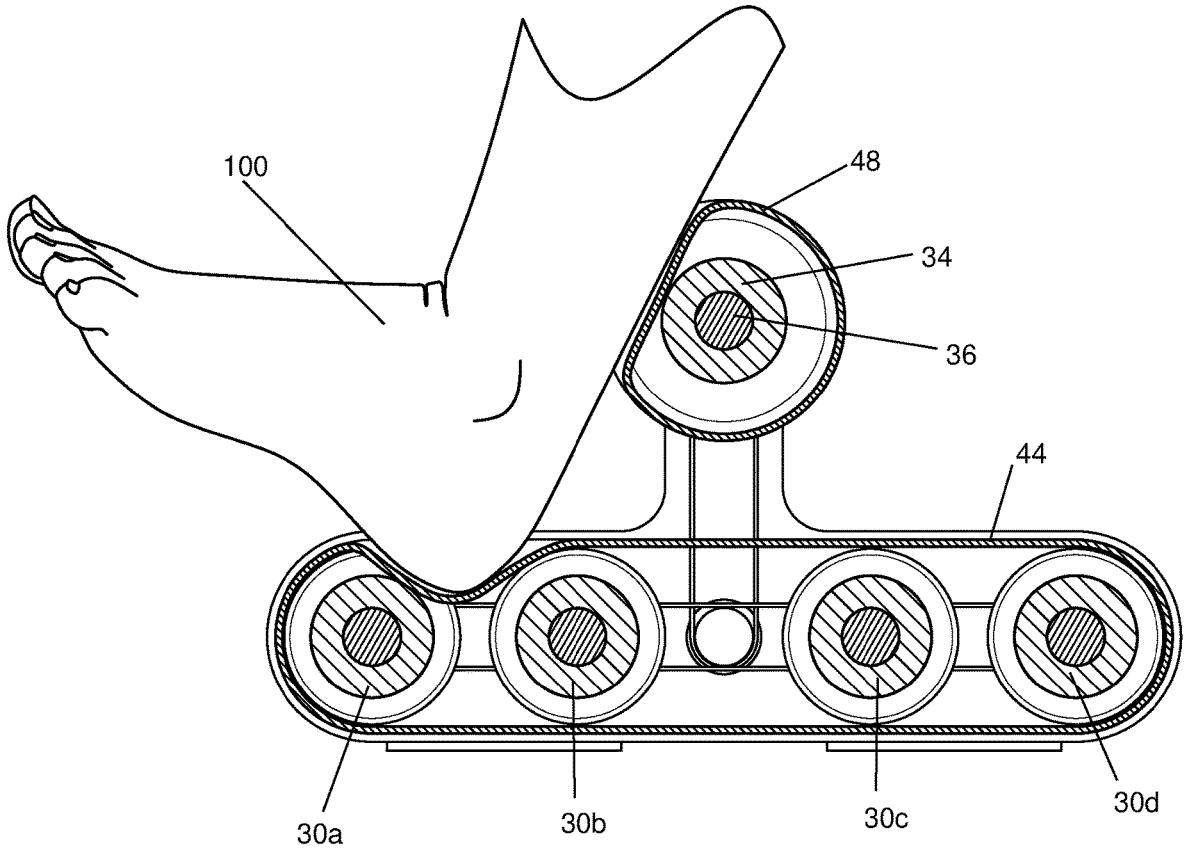

Reference is now made to FIGS. 4A, 4B, and 4C, which are sectional illustrations of the foot cleaning device 10, during use thereof, according to embodiments of the disclosed technology.

In FIG. 4A, a user places their foot 100 on sheet roll 44, substantially at the center thereof, such that the sole of the foot rests against the indented central portion of the rollers. A top surface of the user's foot engages sheet roll 48 and upper roller 34. The user may then move their foot back and forth along sheet roll 44, causing the rotation of rollers 30*a*-30*d* and 34, resulting in a cleaning of the top and bottom of the user's foot.

In FIG. 4B, the user leans the sole of their foot 100 against sheet roll 48, substantially at the center thereof, such that the heel rests against roller 30*d*. As the user rolls their foot along sheet roll 48, rollers 30*a*-30*d* and 34 rotate, thereby massaging the bottom of the user's foot and their heal.

In FIG. 4C, the user leans the heal of their foot 100 against sheet roll 44, between rollers 30*a* and 30*b*, substantially at the center thereof, such that the with the back of the leg, above the ankle, leans on sheet roll 48. As the user rolls their heal along sheet roll 44, rollers 30*a*-30*d* and 34 rotate, thereby massaging the bottom of the back of the user's leg and their heal.

The embodiment illustrated in FIGS. 1A to 4C shows four lower rollers 30*a*, 30*b*, 30*c* and 30*d*. However, any number of lower rollers is considered to be within the scope of the disclosed technology. Additionally, in some embodiments, device 10 may include only two spaced apart rollers (e.g. rollers 30*a* and 30*d* in FIG. 2), having a gap therebetween. However, any gaps between rollers of the device must be sufficiently small to support the user's foot, when placed on sheet roll 44.

Figure 5A:
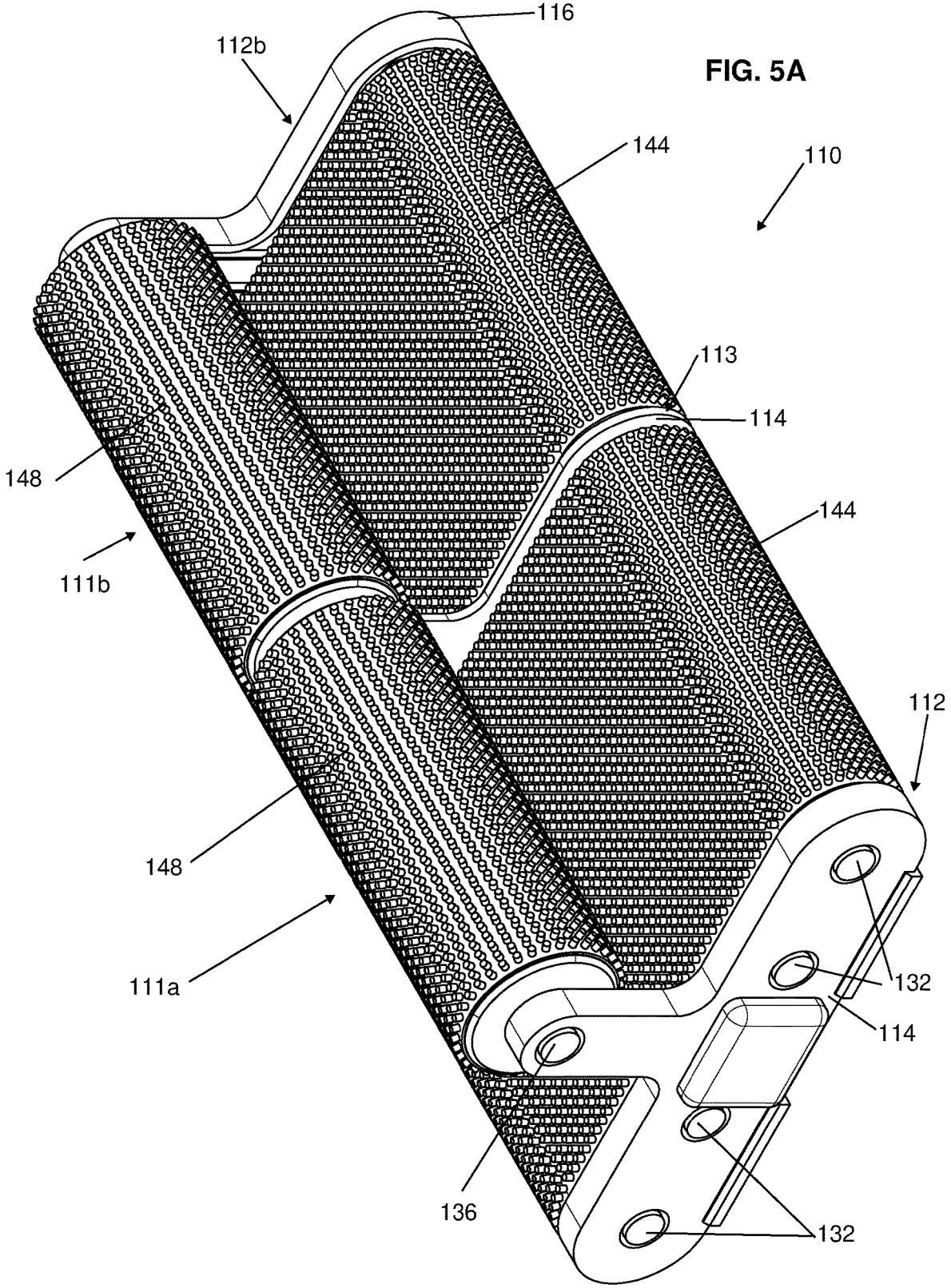
FIGS. 5A and 5B are, respectively, a perspective view illustration and a front view planar illustration of a double foot cleaning device according to embodiments of the present invention.
Figure 5B:
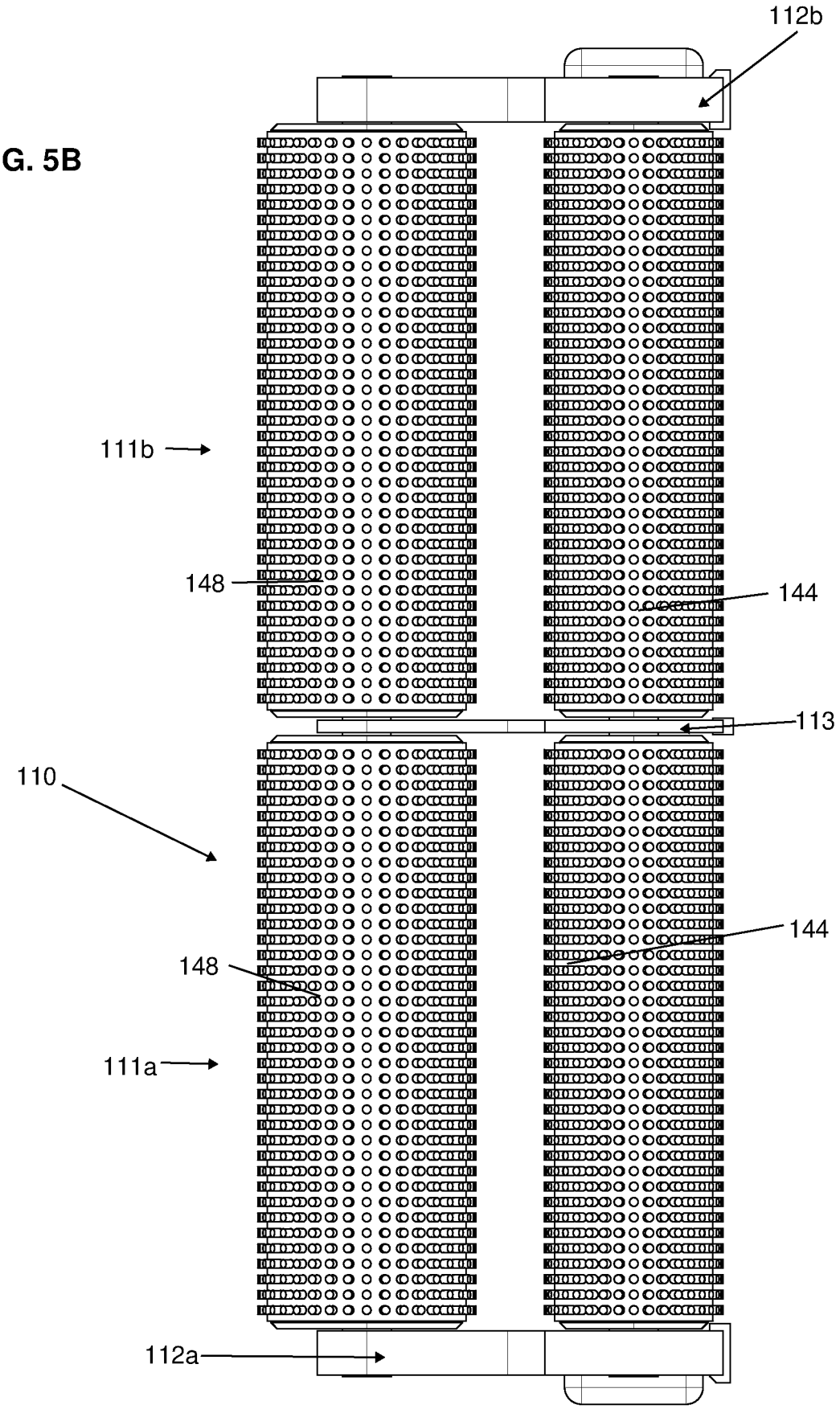

Reference is now made to FIGS. 5A and 5B, which are, respectively, a perspective view illustration and a front view planar illustration of a double foot cleaning device 110 according to embodiments of the present invention.

Foot cleaning device 110 of FIGS. 5A and 5B includes two foot cleaning units 111*a* and 111*b*, each similar to the foot cleaning device of FIG. 1B.

Specifically, the foot cleaning device 110 includes two T-shaped frame portions 112*a* and 112*b* on opposing ends of the device, and a T-shaped interim frame portion 113 at the center of the device. T-shaped interim frame portion 113 is substantially similar to T-shaped frame portions 12 of FIG. 1A, and includes a planar surface 114, but is devoid of a lip (like lip 16 of FIGS. 1A and 1B).

Disposed between frame portion 112*a* and interim frame portion 113, as well as between interim frame portion 113 and frame portion 112*b*, are two sets of lower rollers, each similar to rollers 30*a*-30*d*, enclosed in a sheet roll 144, similar to sheet roll 44 of FIG. 1B. Upper rollers similar to upper roller 34, enclosed in a sheet roll 148, is also disposed between frame portion 112*a* and interim frame portion 113, as well as between interim frame portion 113 and frame portion 112*b*. As such, device 110 includes two rolling units, which may be used for, example, for massaging the user's two feet, simultaneously.

In some embodiments, the axes 132 and 136 extend from frame portion 112*a* to frame portion 112*b*, via sockets in interim frame portion 113. In such embodiments, linking bands (such as bands 38 and 42 of FIG. 2) are present only adjacent frame portions 112*a* and 112*b*, and not adjacent interim frame portion 113. Additionally, in this embodiment, the rollers in both units 111*a* and 111*b* rotate simultaneously, and in the same directions.

In other embodiments, each of units the axes 132 and 136 of unit 111*a* are separate from the axes of unit 111*b*. The axes of both units may be fitted within the same sockets of interim frame portion 113. In this embodiment, the rollers of each of units 111*a* and 111*b* may rotate independently of each other.

While the disclosed technology has been taught with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods and apparatuses described hereinabove are also contemplated and within the scope of the invention.

The invention claimed is:

1. A cleaning device comprising:

at least one T-shaped frame;

a first sheet roll surrounding an internal space, said at least one T-shaped frame abutting said internal space;

first and second rollers, spaced apart from each other within said internal space and disposed at opposite first and second ends of said at least one T-shaped frame, said first sheet roll abutting each of said first and second rollers;

a third roller, exterior to, and spaced apart from, said first sheet roll, rotatably attached to said at least one T-shaped frame at a third end thereof.

2. The cleaning device of claim 1, wherein said first and second rollers form part of a plurality of interconnected rollers disposed within said internal space, wherein said first sheet roll abutting each of said plurality of interconnected rollers.

3. The cleaning device of claim 2, wherein said plurality of interconnected rollers are interconnected by a first linking band, such that when any one of said plurality of interconnected rollers is rotated, the other rollers rotate therewith.

4. The cleaning device of claim 2, wherein said plurality of interconnected rollers are held inline with, and parallel to each other.

5. The cleaning device of claim 2, wherein said at least one T-shaped frame comprises two parallel T-shaped frames abutting opposing sides of said internal space defined by said first sheet roll, each of said two parallel T-shaped frames including a metal lip surrounding said plurality of interconnected rollers.

6. The cleaning device of claim 5, wherein said third roller is held apart from said plurality of interconnected rollers by said metal lips of said two parallel T-shaped frames.

7. The cleaning device of claim 5, wherein said third roller is connected to said plurality of interconnected rollers by a second linking band, such that a line from a center of said third roller to a center of a closest roller of said plurality of interconnected rollers is substantially perpendicular to a line running through a center of each roller of said plurality of interconnected rollers.

8. The cleaning device of claim 7, wherein rotation of said third roller causes rotation of said plurality of interconnected rollers.

9. The cleaning device of claim 1, wherein each of said first, second, and third rollers includes two end portion having a first diameter, and a central portion, disposed between said end portions, having a second diameter, said second diameter being smaller than said first diameter.

10. The cleaning device of claim 1, wherein said third roller is enclosed in a second sheet roll.

11. The cleaning device of claim 10, wherein at least one of said first sheet roll and said second sheet roll has a textured exterior surface.

12. A method of using a cleaning device comprising:

acquiring a cleaning device having at least one T-shaped frame, a first sheet roll surrounding an internal space, said at least one T-shaped frame abutting said internal space, first and second rollers, spaced apart from each other within said internal space and disposed at opposite first and second ends of said at least one T-shaped frame, said first sheet roll abutting each of said first and second rollers, and a third roller, exterior to, and spaced apart from, said first sheet roll, rotatably attached to said at least one T-shaped frame at a third end thereof;

placing a foot between the first sheet roll and the third roller; and moving said foot toward and/or away from a roller of said first and second rollers.

13. The method of using the cleaning device of claim 12 further comprising a step of:

placing a sole of a foot on said third roller, and placing a heel of the foot on said first sheet roll.

14. The method of claim 12, further comprising a steps of:

placing a sole of a foot on said first sheet roll, and placing an ankle supporting the foot on said third roller.

* * * * *